US005322166A

United States Patent [19]

Crowther

[11] Patent Number: 5,322,166

[45] Date of Patent: Jun. 21, 1994

[54] PILL STORAGE AND DISPENSING CONTAINER

[76] Inventor: Jonathan M. Crowther, 2609 Stephenson Dr., Wilmington, Del. 19808

[21] Appl. No.: 55,727

[22] Filed: Apr. 30, 1993

[51] Int. Cl.[5] ..... B65D 83/04; G07F 11/00

[52] U.S. Cl. ..... 206/538; 206/534; 221/5; 221/90; 221/277

[58] Field of Search ..... 206/533, 534, 538, 539; 221/89, 90, 277, 265, 79, 81, 82, 5, 24, 25

[56] References Cited

U.S. PATENT DOCUMENTS

| | | | |
|---|---|---|---|
| 3,393,795 | 7/1968 | Covert, Jr. | 206/533 X |
| 3,570,707 | 3/1971 | Finkel | 221/5 |
| 4,646,936 | 3/1987 | Frazier et al. | 221/5 |
| 4,809,877 | 3/1989 | Albright | 221/82 X |

FOREIGN PATENT DOCUMENTS

| | | | |
|---|---|---|---|
| 1227370 | 8/1960 | France | 206/538 |

*Primary Examiner*—Bryon P. Gehman
*Attorney, Agent, or Firm*—Connolly & Hutz

[57] ABSTRACT

A pill storage and dispensing container has a lower storage unit with a plurality of radially arranged individual pill storage compartments. An upper storage unit positioned directly above and nestled within the lower unit also has a plurality of similarly arranged storage compartments as well as one bottomless compartment. A top cover is positioned directly above the upper storage unit, and a dispensing opening in the cover is arranged to communicate with the various compartments in the upper unit as well as with the bottomless compartment and the various compartments of the lower storage unit as the cover is rotated relative to the storage units. A hub shaft releasably interconnects the upper and lower storage units and the top cover while allowing the storage units and cover to rotate relative to on another. Twenty eight individual storage compartments are provided in a compact container which enables pills to be dispensed four times per day over a seven day period.

20 Claims, 5 Drawing Sheets

PILL STORAGE AND DISPENSING CONTAINER

BACKGROUND OF THE INVENTION

The present invention relates to a pill storage and dispensing container, and more particularly to such a container having a plurality of individual compartments for storing and dispensing pills over an extended period of time.

Prior to the present invention numerous constructions have been proposed for the storage and dispensing of various medicines in pill form. The term pill as expressed throughout this disclosure is used in its broadest sense and is intended to include any and all discrete forms such as tablets, capsules and the like. The heretofore available constructions have not adequately addressed the storage and dispensing of pills for heavy prescription regimes. For example, current arrangements that store four pill applications per day over a seven day period tend to be extremely bulky and cumbersome. Moreover, since these arrangements are difficult to carry and use, their effectiveness is therefore extremely limited.

SUMMARY OF THE INVENTION

Accordingly, among the objects of the present invention is a pill storage and dispensing container which is compact, simple in construction and easy to use.

Another object of the present invention is a pill storage and dispensing container having individual storage compartments which enable pills to be dispensed up to four times per day over an extended period of time.

Still another object of the present invention is a pill storage and dispensing container which is easily filled with pills in a programable manner for subsequent dispensing.

In accordance with the present invention, a pill storage and dispensing container comprises a lower storage unit having a plurality of radially arranged individual storage compartments, and an upper storage unit positioned directly above the lower unit also having a plurality of radially arranged individual storage compartments as well as one bottomless compartment. A top cover positioned directly above the upper storage unit has a dispensing opening therein through which pills are dispensed from the container. A hub shaft releasably interconnects the upper and lower storage units and the top cover while allowing the storage units and cover to rotate relative to one another. The dispensing opening in the top cover communicates with the individual storage compartments in the upper storage unit to dispense pills in these compartments as the cover rotates about the hub shaft relative to the upper unit. The dispensing opening in the top cover also communicates with the bottomless compartment in the upper storage unit and the individual storage compartments in the lower storage unit to dispense pills in these compartments as the cover and upper unit rotate together relative to the lower unit.

Releasable locking structure on the upper and lower storage units is constructed and arranged to lock these units together as the cover rotates relative to the upper storage unit and the dispensing opening communicates with each of the compartments in the upper unit. Once the compartments in the upper unit are emptied of their pills, the upper and lower storage units are released from locked engagement with one another and the top cover is locked to the upper storage unit. When the upper and lower storage units are released from their locked engagement and the upper unit is locked to the cover, the dispensing opening in the cover is positioned directly above the bottomless compartment in the upper storage unit where it remains throughout dispensing from the lower storage unit. Continued rotation of the top cover and the upper storage unit locked to it, positions the dispensing opening in communication with the compartments of the lower storage unit.

The top cover may have an undersurface with spaced apart cams downwardly extending therefrom positioned between upstanding radially arranged sidewalls defining the compartments of the upper storage unit. Each of the cams includes a forward sloping surface that allows the cams to slide over the side walls as the cover is indexed from one compartment in the upper storage unit to the next. These cams also include a trailing abutment surface that engages the side walls to prevent reverse movement of the top cover relative to the upper storage unit.

The upper storage unit also has an undersurface with similar cams downwardly extending therefrom positioned between the upstanding radially arranged side walls of the lower storage unit. The cams on the undersurface of the upper storage unit cooperate with the side walls of the lower storage unit in the same manner as the cams on the top cover as the cover and upper unit are indexed together from one compartment in the lower storage unit to the next.

The top cover and the upper and lower storage units each include a central opening, and the hub shaft extends through the central openings to releasably connect the top cover and the upper and lower storage units together. Biasing structure urges the top cover and the upper storage unit together as well as the upper and lower storage units together.

Preferably the upper storage unit includes thirteen individual storage compartments numbered one through thirteen, and the lower storage unit preferably includes fifteen individual storage compartments numbered fourteen through twenty-eight. Moreover, the top cover may include a transparent viewing window adjacent to and forward of the dispensing opening for viewing the next compartment to be dispensed. The window may be magnified, if desired.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
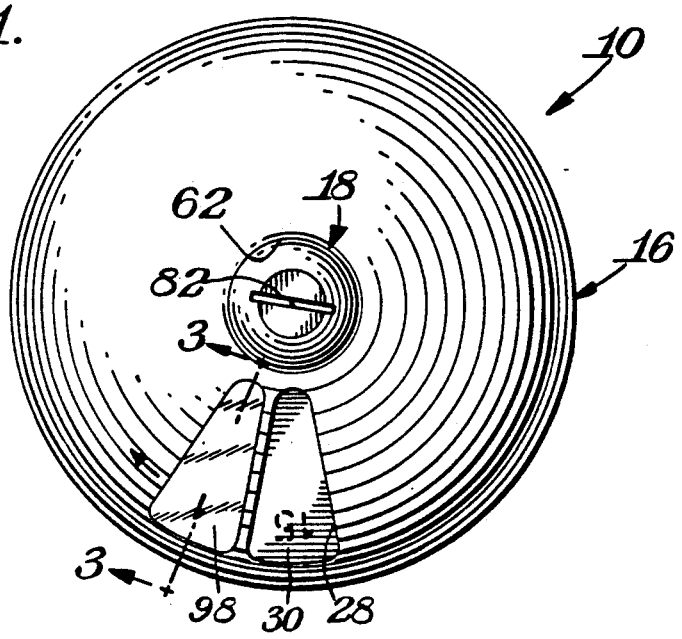
FIG. 1 is a top plan view of a pill storage and dispensing container, according to the present invention, with the container at its starting position of dispensing from the upper storage unit.

Referring in more particularity to the drawings, FIGS. 1–4 illustrate a pill storage and dispensing container 10 which includes a lower storage unit 12, an upper storage unit 14, a top cover 16 and a hub shaft 18. Lower storage unit 12 has a plurality of radially arranged individual storage compartments 20 each having an integral bottom wall for receiving pills 22 to be dispensed. Similarly, upper storage unit 14 also includes a plurality of radially arranged individual storage compartments 24 each having an integral bottom wall as well as one bottomless compartment 26 which provides access to the lower storage unit. Top cover 16 has a dispensing opening 28 therein for dispensing pills 22 from the container as the opening is indexed from one storage compartment to the next. Hub shaft 18 allows the storage units 12, 14 and cover 16 to rotate relative to one another throughout the dispensing cycle.

Figure 2:
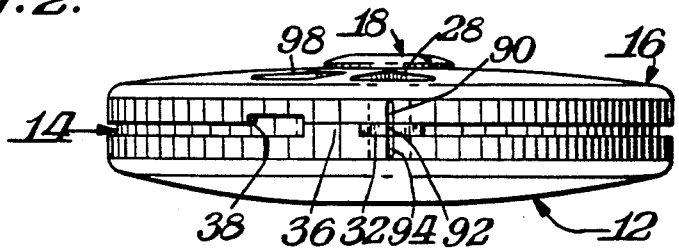
FIG. 2 is a side elevational view of the container shown in FIG. 1.
Figure 3:
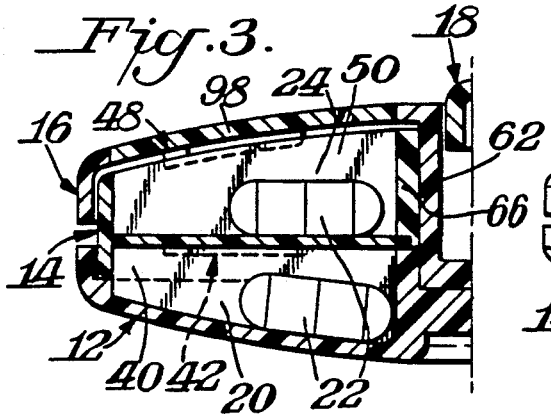
FIG. 3 is a sectional view taken along line 3—3 of FIG. 1.
Figure 19:
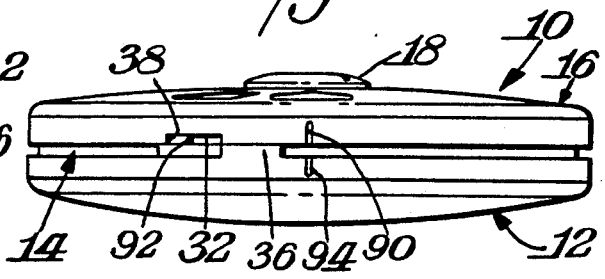
FIG. 19 is a side elevational view of a pill storage and dispensing container partially through its dispensing cycle from the lower storage unit.
Figure 4:
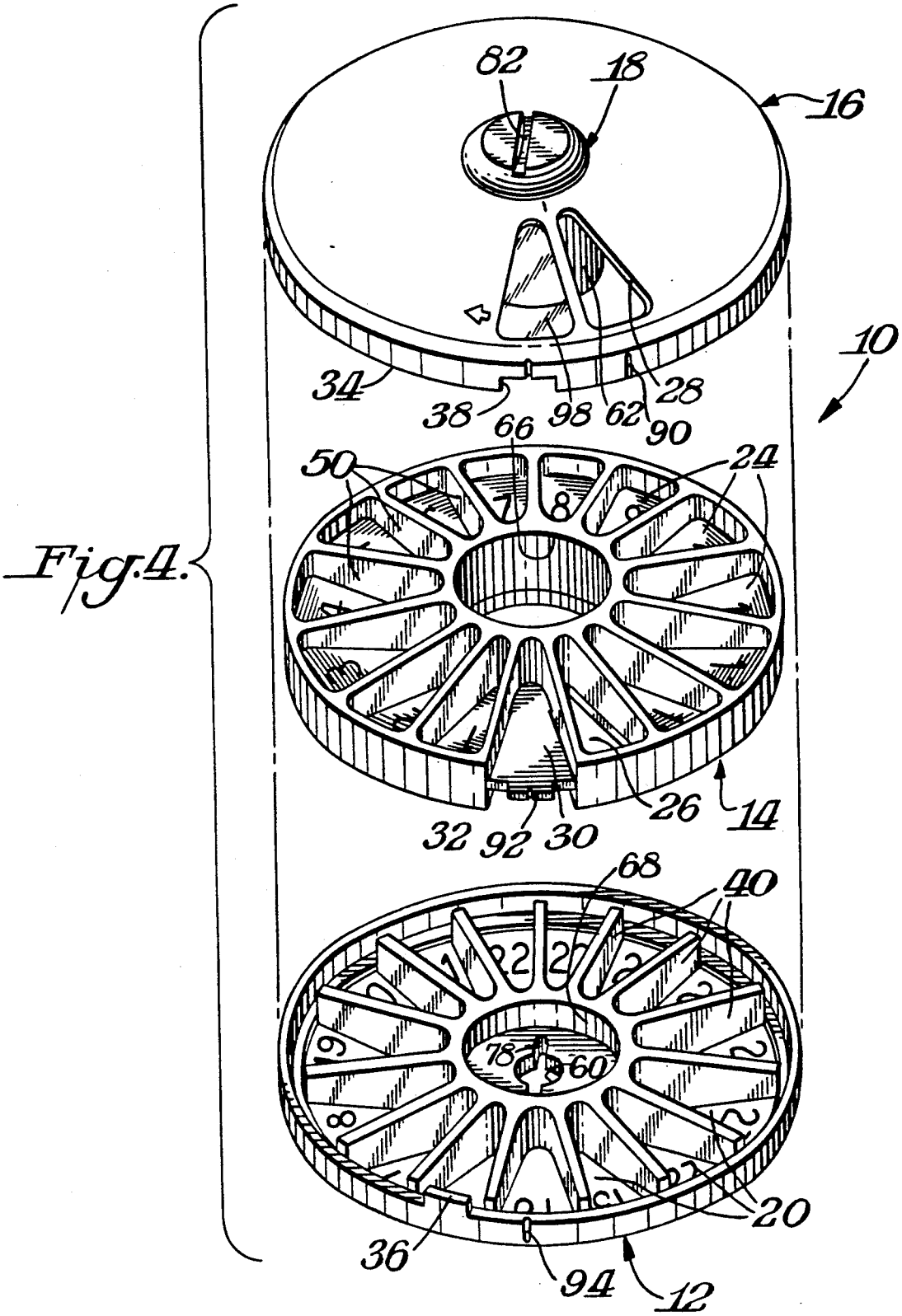
FIG. 4 is an exploded perspective view of a pill storage and dispensing container midway through its dispensing cycle at the start of dispensing from the lower storage unit.
Figure 5:
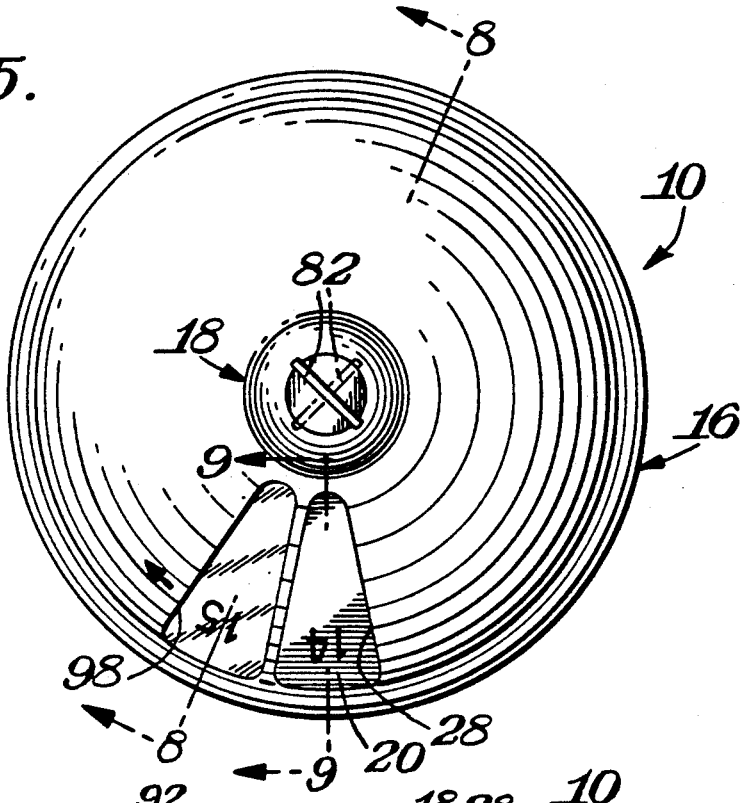
FIG. 5 is a top plan view of the container midway through its dispensing cycle at the start of dispensing from the lower storage unit.

The pill storage and dispensing container of the present invention includes locking structure on the upper and lower storage units for releasably locking these units together as the cover rotates relative to upper storage unit and the dispensing opening communicates with each of the storage compartments in the upper unit. The releasable locking structure comprises an upwardly biased flap 30 on the upper storage unit having an outwardly extending tab 32. The relationship of the top cover and the upper storage unit is such that the peripheral portion 34 of the top cover maintains tab 32 in a downwardly depressed position against an abutting projection 36 on the lower storage unit, as shown in FIG. 2. These components in these positions function to lock the upper and lower storage units together.

Figure 6:
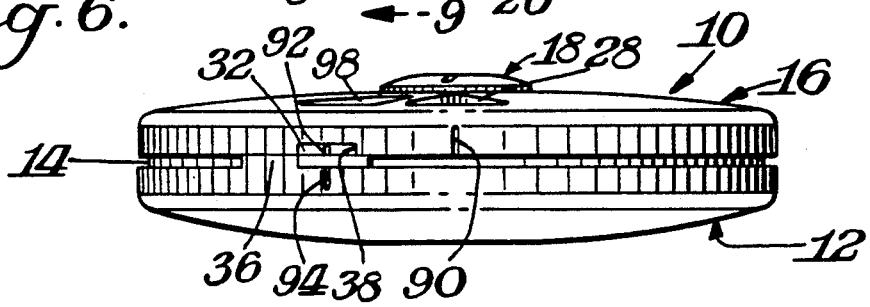
FIG. 6 is a side elevational view of the container shown in FIG. 5.
Figure 7:
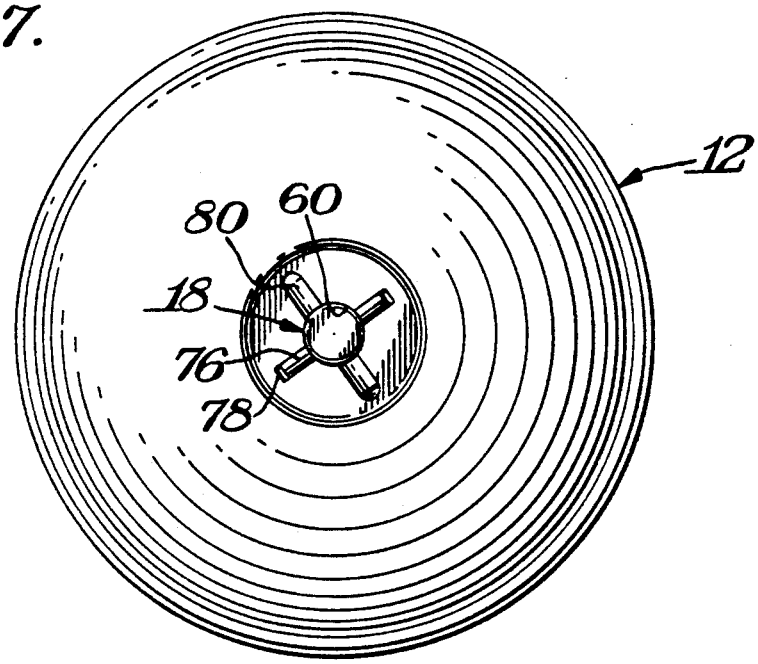
FIG. 7 is a bottom plan view of the container shown in FIGS. 5 and 6.

The peripheral portion 34 of top cover 16 includes a notch 38 arranged to receive tab 32 of the upwardly biased flap 30. When this occurs the upper and lower storage units are released from locked engagement with one another, and simultaneously therewith the upper storage unit 14 is locked to the top cover 16 for movement with the cover when it is caused to rotate. This position is best shown in FIG. 6.

Each of the individual storage compartments 20 of the lower storage unit 12 includes upstanding radially arranged sidewalls 40. The upper storage unit 14 has an undersurface with cams 42 downwardly extending therefrom positioned between these sidewalls 40 of the lower unit. Three cams are provided spaced 120° apart. Each cam 42 has a forward sloping surface 44 that allows the cam to slide over the sidewalls 40 as the upper storage unit and cover are indexed together from one compartment 20 in the lower storage unit 12 to the next. Additionally, each of the cams 42 includes a trailing abutment surface 46 that engages the sidewalls to prevent reverse movement of the top cover and upper storage unit relative to the lower storage unit.

In similar fashion, top cover 16 also has an undersurface with cams 48 downwardly extending therefrom positioned between upstanding radially arranged sidewalls 50 on the upper storage unit. Each of the cams 48 includes a forward sloping surface 52 and a trailing abutment surface 54 which function in the same manner as cams 42 when the top cover is indexed from one compartment 24 in the upper storage unit to the next.

Figure 8:
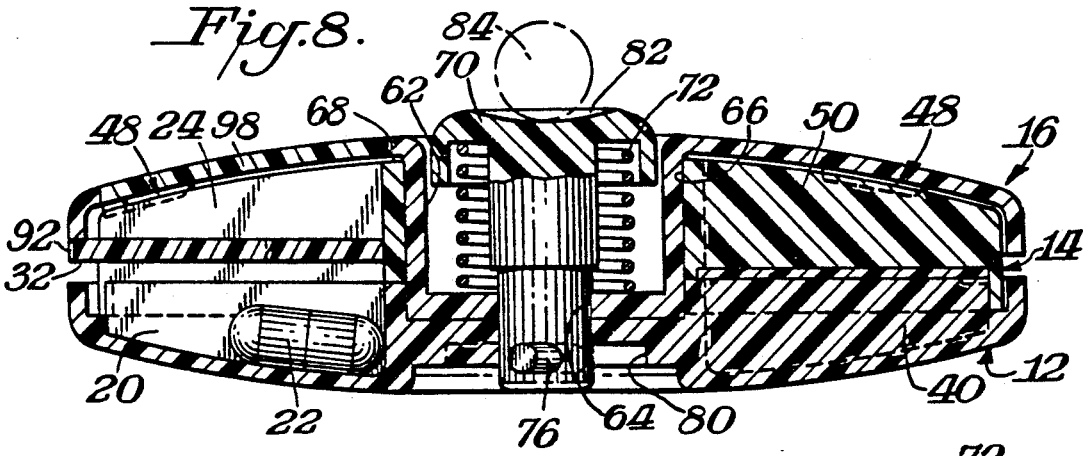
FIG. 8 is a sectional view taken along line 8—8 of FIG. 5.
Figure 9:
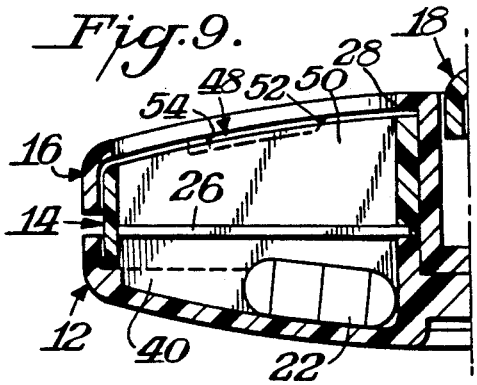
FIG. 9 is a sectional view taken along line 9—9 of FIG. 5.
Figure 10:
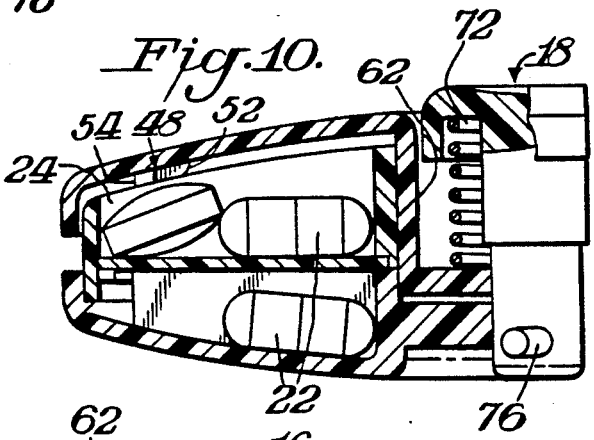
FIG. 10 is a sectional view similar to FIG. 9 illustrating the camming action between the top cover and the upper storage unit as the container is indexed from one storage compartment in the upper unit to the next.
Figure 12:
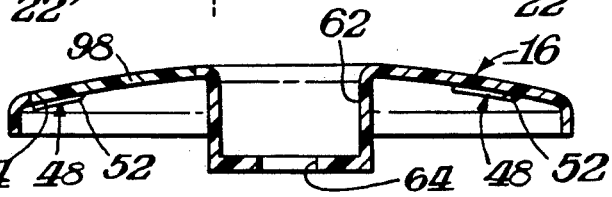
FIG. 12 is a sectional view taken along line 12—12 of FIG. 11.
Figure 11:
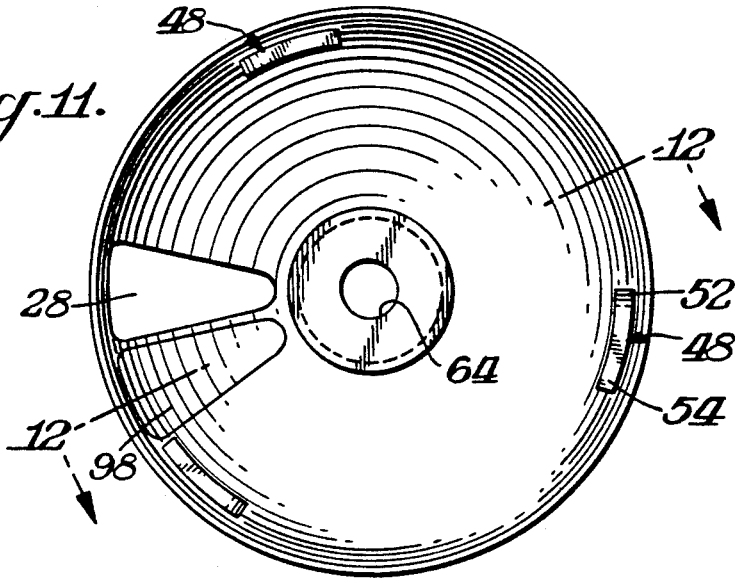
FIG. 11 is a bottom plan view of the top cover.
Figure 13:
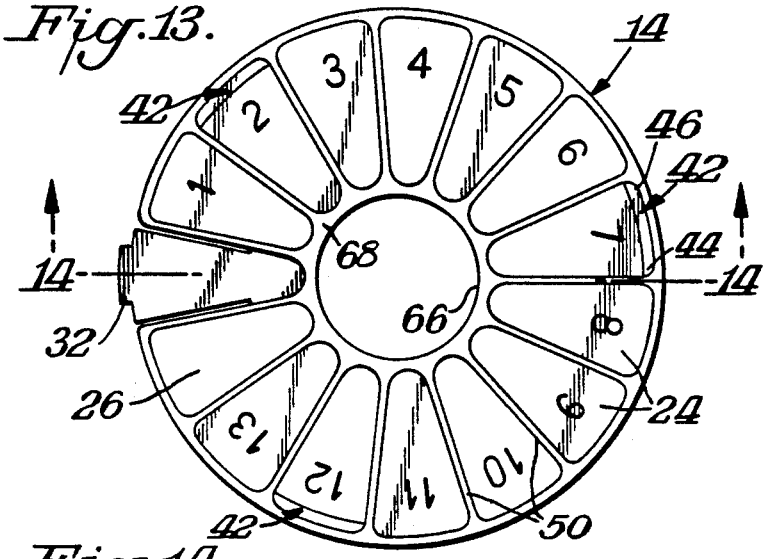
FIG. 13 is a top plan view of the upper storage unit.

As noted above, the hub shaft 18 functions to releasably interconnect the upper and lower storage units and the top cover while allowing the storage units and cover to rotate relative to one another. As shown best in FIG. 8, lower storage unit 12 includes a central opening 60 through which the hub shaft extends. Similarly, the top cover 16 includes a cylindrical hub 62 with a central opening 64 therein through which the shaft extends. The cylindrical hub in the cover fits into a complimentary cylindrical socket 66 in the lower storage unit. Additionally, the upper storage unit 14 includes a cylindrical open-ended sleeve 68 which receives the cylindrical hub 62 in the top cover, as shown in FIGS. 8–10.

Hub shaft 18 includes an inverted cup-shaped upper member 70, and biasing structure in the form of a coil spring 72 reacts between the base of the cylindrical hub 62 in the top cover and the inverted cup-shaped member 70 of the hub shaft. The biasing structure enables the top cover to move in a upward direction slightly away from the upper storage unit 14 as the cams 48 ride over the side walls 50 of the upper unit. Similarly, the biasing structure 72 enables both the cover 16 and upper storage unit 14 to move away from the lower storage unit when the cams 42 ride over the sidewalls 40 of the lower unit.

Figure 15:
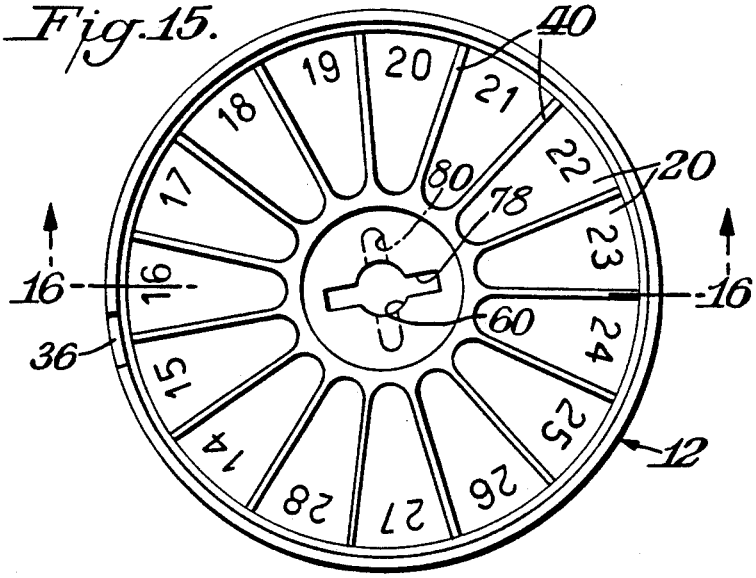
FIG. 15 is a top plan view of the lower storage unit.
Figure 16:
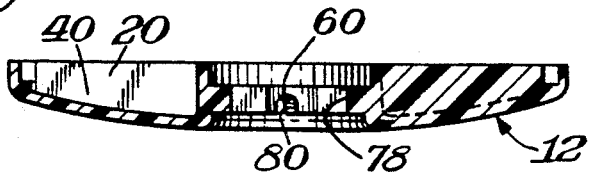
FIG. 16 is a sectional view taken along line 15—15 of FIG. 15.

Hub shaft 18 includes a transverse pin 76 at the lower end thereof, and as shown best in FIG. 15, the lower storage unit 12 includes a slotted opening 78 dimensioned to receive the transverse pin. Additionally, the lower storage unit includes a slotted recess 80 on the undersurface thereof for receiving the transverse pin in a releasably locked position. When the pill storage and dispensing container 10 is assembled, the transverse pin 76 of hub shaft 18 extends through slotted opening 78 and the hub shaft is then rotated to position the pin in slotted recess 80. A slot 82 at the top of the hub shaft is arranged to receive a coin 84 or similar mechanism to facilitate rotation of the hub shaft relative to the upper end and lower storage units and the top cover when container 10 is assembled and disassembled. Alternatively, the top of the hub shaft may include handle structure to facilitate such rotation.

As explained more fully below, the top cover and the upper and lower storage units each include an alignment mark on the outside thereof for properly positioning these components at the start of a dispensing cycle after the container is filled with pills. As shown best in FIG. 2, the top cover 16 includes an alignment mark 90 while the upper storage unit 14 includes an alignment mark 92 on tab 32. The lower storage unit 12 includes an alignment mark 94.

The upper storage unit includes thirteen individual storage compartments 24 numbered 1 through 13 together with the bottomless compartment 26. Additionally, the lower storage unit 12 includes fifteen individual storage compartments 20 numbered 14 through 28.

The top cover includes a transparent viewing window 98 adjacent to and forward of dispensing opening 28 so that the contents of the next compartment to be dispensed may be viewed. Viewing window 98 may be magnified, if desired.

The operation of the pill storage and dispensing container 10 is as follows. First, each of the twenty-eight storage compartments in the upper and lower storage units is filled with the necessary pills 22 in the desired sequence. Assuming pills are to be dispensed four times per day, each of the compartments numbered 1 through 4 is filled, and the sequence is then repeated for six additional days. The upper storage unit 14 is then positioned directly above the lower storage unit 12 so that outside mark 92 on tab 32 of the upper storage unit is in direct alignment with mark 94 on the outside of the lower unit. This positions the tab 32 against the abutting projection 36 on the lower unit. The upper unit nests within the lower unit, as shown best in FIG. 3. Next, the top cover 16 is positioned directly above the upper storage unit 14 so that its marking 90 is in alignment with the marks 92 and 94, as shown best in FIG. 2. The hub shaft 18 is then connected as described above. Biasing structure 72 urges the peripheral portion 34 of the top cover against the tab of upwardly biased flap 30 to maintain the tab against projection 36 and thereby lock the upper and lower storage units together.

The pill storage and dispensing container 10 is now assembled at its starting position and the viewing window 98 is directly over storage compartment in the upper unit. While grasping the storage lower unit which is locked to the upper storage unit and rotating the top cover in a clockwise direction, the cams 48 on the underside of the top cover ride over the sidewalls 50 of the upper unit to index the dispensing opening 28 to a position over compartment 1. Container 10 is then inverted and the pills of compartment 1 are dispensed. This action positions the viewing window 98 over compartment 2 and the process is repeated until each of the thirteen compartments of the upper storage unit is dispensed.

When the dispensing opening is ultimately positioned over compartment 13 in the upper storage unit the viewing window 98 is positioned over the bottomless compartment 26 for viewing the contents of compartment 14 in the lower unit. The cover is then indexed to dispense the contents of compartment 14 and this positions tab 32 directly below notch 38. The upward biasing action of flap 38 snaps the tab into the notch to thereby lock the upper storage unit to the cover and simultaneously unlock the upper and lower storage units from locked engagement with one another. With the upper storage unit locked to the cover continued rotation of the cover relative to the lower unit positions each of the compartments 15–28 in communication with the bottomless compartment 26 and the dispensing opening. The cams 42 on the undersurface of the upper storage unit 14 provide the indexing function and prevent reverse rotation of the cover and upper storage unit relative to the lower unit. Once emptied of pills, the container can be disassembled, refilled with pills and assembled for another dispensing cycle.

Figure 17:
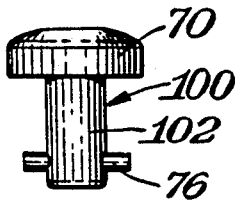
FIG. 17 is a side elevational view of a modified hub shaft, according to the present invention.
Figure 18:
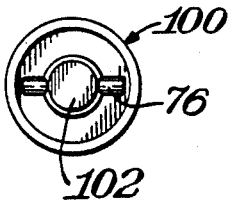
FIG. 18 is a bottom plan view of the hub shaft shown in FIG. 17.
Figure 14:
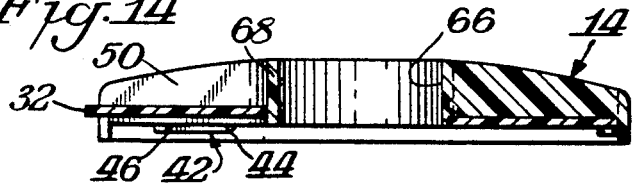
FIG. 14 is a sectional view taken along line 14—14 of FIG. 13.

FIGS. 17 and 18 illustrate a modified hub shaft 100 having an axial portion 102 of uniform cross-section. Otherwise, hub shaft 100 is similar to hub shaft 18.

What is claimed is:

1. A pill storage and dispensing container comprising a lower storage unit having a plurality of radially arranged individual storage compartments each having an integral bottom wall, an upper storage unit positioned directly above the lower unit having a plurality of radially arranged individual storage compartments each having an integral bottom wall and a single bottomless compartment, a top cover positioned directly above the upper storage unit having a dispensing opening therein, and a hub shaft releasably interconnecting the upper and lower storage units and the top cover while allowing the storage units and cover to rotate relative to one another whereby the dispensing opening in the top cover communicates with the individual storage compartments in the upper storage unit as the cover rotates relative to the upper unit and whereby the dispensing opening in the top cover communicates with the bottomless compartment in the upper storage unit and the individual storage compartments in the lower storage unit as the cover and upper unit rotate relative to the lower unit.

2. A pill storage and dispensing container as in claim 1 herein each of the individual storage compartments in the upper and lower storage units includes upstanding radially arranged side walls.

3. A pill storage and dispensing container as in claim 2 wherein the top cover has an undersurface with cam means downwardly extending therefrom positioned between the upstanding radially arranged side walls of the upper storage unit for indexing the dispensing opening in the cover from one compartment in the upper storage unit to the next, the cam means including a forward sloping surface that allows the cam means to slide over the side walls as the cover is indexed from one compartment in the upper storage unit to the next and a trailing abutment surface that engages the side walls to prevent reverse movement of the top cover relative to the upper storage unit.

4. A pill storage and dispensing container as in claim 3 wherein the cam means includes three individual cams spaced 120° apart.

5. A pill storage and dispensing container as in claim 2 wherein the upper storage unit has an undersurface with cam means downwardly extending therefrom positioned between the upstanding radially arranged side walls of the lower storage unit for indexing and dispensing opening in the cover from one compartment in the lower storage unit to the next, the cam means including a forward sloping surface that allows the cam means to slide over the side walls as the upper storage unit and cover are indexed from one compartment in the lower storage unit to the next and a trailing abutment surface that engages the side walls to prevent reverse movement of the top cover and upper storage unit relative to the lower storage unit.

6. A pill storage and dispensing container as in claim 1 wherein the upper storage unit includes thirteen individual storage compartments numbered one through thirteen and the bottomless compartment.

7. A pill storage and dispensing container as in claim 6 wherein the lower storage unit includes fifteen individual storage compartments numbered fourteen through twenty-eight.

8. A pill storage and dispensing container as in claim 1 including a transparent viewing window in the top cover adjacent to and forward of the dispensing opening whereby the contents of the next compartment to be dispensed may be viewed.

9. A pill storage and dispensing container as in claim 8 wherein the viewing window is magnified.

10. A pill storage and dispensing container comprising a lower storage unit having a plurality of radially arranged individual storage compartments, an upper storage unit positioned directly above the lower unit having a plurality of radially arranged individual storage compartments and one bottomless compartment, a top cover positioned directly above the upper storage unit having a dispensing opening therein, and a hub shaft releasably interconnecting the upper and lower storage units and the top cover while allowing the storage units and cover to rotate relative to one another whereby the dispensing opening in the top cover communicates with the individual storage compartments in the upper storage unit as the cover rotates relative to the upper unit and whereby the dispensing opening in the top cover communicates with the bottomless compartment in the upper storage unit and the individual storage compartments in the lower storage unit as the cover and upper unit rotate relative to the lower unit, and releasable locking means on the upper and lower storage units constructed and arranged to lock the units together as the cover rotates relative to the upper storage unit and the dispensing opening communicates with each of the storage compartments in the upper unit and then to release the storage units from locked engagement with one another.

11. A pill storage and dispensing container as in claim 10 wherein the releasable locking means is constructed and arranged to lock the top cover and upper storage unit together when the upper and lower storage units are released from locked engagement with one another.

12. A pill storage and dispensing container as in claim 11 wherein the dispensing opening in the top cover is positioned directly above the bottomless compartment in the upper storage unit when the upper and lower storage units are released from locked engagement with one another and the upper unit is locked to the cover.

13. A pill storage and dispensing container as in claim 12 wherein the releasable locking means includes an upwardly biased flap on the upper storage unit having an outwardly extending tab, an upwardly extending projection on the lower storage unit forward of the tab and abutting the tab, and a peripheral portion on the top cover which maintains the tab in a downwardly depressed position abutting the projection whereby the upper and lower storage units are locked together.

14. A pill storage and dispensing container as in claim 13 wherein the releasable locking means further includes a notch in the peripheral portion of the cover constructed and arranged to receive the tab on the flap and thereby release the upper and lower storage units from locked engagement with one another while locking the upper storage unit to the cover.

15. A pill storage and dispensing container comprising a lower storage unit having a plurality of radially arranged individual storage compartments, an upper storage unit positioned directly above the lower unit having a plurality of radially arranged individual storage compartments and one bottomless compartment, a top cover positioned directly above the upper storage unit having a dispensing opening therein, and a hub shaft releasably interconnecting the upper and lower storage units and the top cover while allowing the storage units and cover to rotate relative to one another whereby the dispensing opening in the top cover communicates with the individual storage compartments in the upper storage unit as the cover rotates relative to the upper unit and whereby the dispensing opening in the top cover communicates with the bottomless compartment in the upper storage unit and the individual storage compartments in the lower storage unit as the cover and upper unit rotate relative to the lower unit, and wherein the top cover and the upper and lower storage units each includes a central opening, the hub shaft extending through the central openings connecting the top cover and the upper and lower storage units together, and biasing means urging the top cover and upper storage unit together and the upper and lower storage units together.

16. A pill storage and dispensing container as in claim 5 wherein each of the individual storage compartments in the upper and lower storage units includes upstanding radially arranged side walls.

17. A pill storage and dispensing container as in claim 16 wherein the top cover has an undersurface with cam means downwardly extending therefrom positioned between the upstanding radially arranged side walls of the upper storage unit for indexing the dispensing opening in the cover from one compartment in the upper storage unit to the next, the cam means including a forward sloping surface that allows the cam means to slide over the side walls against the force of the biasing means as the cover is indexed from one compartment in the upper storage unit to the next and a trailing abutment surface that engages the side walls to prevent reverse movement of the top cover relative to the upper storage unit.

18. A pill storage and dispensing container as in claim 17 wherein the upper storage unit has an undersurface with cam means downwardly extending therefrom positioned between the upstanding radially arranged side walls of the lower storage unit for indexing the dispensing opening in the cover from one compartment in the lower storage unit to the next, the cam means including a forward sloping surface that allows the cam means to slide over the side walls against the force of the biasing means as the upper storage unit and cover are indexed from one compartment in the lower storage unit to the next and a trailing abutment surface that engages the side walls to prevent reverse movement of the top cover and upper storage unit relative to the lower storage unit.

19. A pill storage and dispensing container as in claim 15 wherein the hub shaft includes releasable means connecting the hub shaft to the storage units and top cover whereby the upper and lower storage units and the cover may be separated from one another and filled with pills when the hub shaft is released.

20. A pill storage and dispensing container comprising a lower storage unit having a plurality of radially arranged individual storage compartments, an upper storage unit positioned directly above the lower unit having a plurality of radially arranged individual storage compartments wall and one bottomless compartment, a top cover positioned directly above the upper storage unit having a dispensing opening therein, and a hub shaft releasably interconnecting the upper and lower storage units and the top cover while allowing the storage units and cover to rotate relative to one another whereby the dispensing opening in the top cover communicates with the individual storage compartments in the upper storage unit as the cover rotates relative to the upper unit and whereby the dispensing opening in the top cover communicates with the bottomless compartment in the upper storage unit and the individual storage compartments in the lower storage unit as the cover and upper unit rotate relative to the lower unit, and wherein the upper and lower storage units and the top cover eachincludes an alignment marking thereon indicating the starting dispensing position when the markings are aligned with one another.

* * * * *